United States Patent [19]

Phillips

[11] Patent Number: 4,756,581

[45] Date of Patent: Jul. 12, 1988

[54] PORTABLE FILE

[76] Inventor: Geoff Phillips, 7248 Arprege Rd., San Diego, Calif. 92119

[21] Appl. No.: 882,501

[22] Filed: Jul. 7, 1986

[51] Int. Cl.[4] ..... A47B 63/00

[52] U.S. Cl. ..... 312/183; 30/358; 312/297; 312/330 R

[58] Field of Search ..... 83/692, 693; 30/366, 30/358; 312/183, 193, 330 R, 188, 191, 192, 297; 211/184

[56] References Cited

U.S. PATENT DOCUMENTS

| | | | |
|---|---|---|---|
| 1,068,819 | 7/1913 | Probert | 211/184 X |
| 1,200,517 | 10/1916 | Ohnstrand | 211/184 X |
| 1,368,443 | 2/1921 | Lackner | 30/358 |
| 1,832,158 | 11/1931 | Vance | 211/184 |
| 3,303,564 | 2/1967 | Hendricks | 30/358 |
| 3,906,633 | 9/1975 | Inoue | 30/358 |
| 3,944,373 | 3/1976 | Farjon et al. | 30/358 X |
| 3,975,105 | 8/1976 | Cline | 30/358 X |

FOREIGN PATENT DOCUMENTS

| | | | |
|---|---|---|---|
| 1909003 | 9/1970 | Fed. Rep. of Germany | 30/358 |
| 428665 | 7/1967 | Switzerland | 30/366 |

*Primary Examiner*—Peter A. Aschenbrenner
*Assistant Examiner*—Thomas A. Rendos
*Attorney, Agent, or Firm*—Frank D. Gilliam

[57] ABSTRACT

The invention is directed to a portable file which comprises an open housing with side walls, an end surface and a base; a translatable container within the housing having a plurality of removable file divider walls, protrusions on the side surface of the file divider walls engage angled slots on the container side walls. The file divider walls include a hinged attachment to the housing bottom surface; a lid similar in construction to the "roll top" of a desk covers the open upper surface of the housing in one extreme translated or "rolled" position to its opposite extreme position where it is stored between the lower surface of the container side walls. With the lid in its stored position, the container can be translated relative to the housing causing the file divider walls and contents to rotate from their stored position where they are closely angled to the housing bottom to a substantially upright file use position. A lock is provided to lock the container to the housing preventing relative translation when in the file stored mode. The file is adaptable to contain Rolodex ® type notched file cards. The open end of the housing may include a dust cover. In one embodiment of the portable file the carrying handle conceals a punch and die set for punching the slots and opening of the type normally associated with Rolodex ® type file cards. Either one or more punches are provided.

17 Claims, 3 Drawing Sheets

PORTABLE FILE

BACKGROUND OF THE INVENTION

The present invention is directed to files and more particularly to a portable file that is storable or transportable in one sized mode and convertible to a second larger size mode when in use.

Various small sized hard and soft files presently available are useful for their intended purpose. The files generally consist of conventional card files and the like constructed of metal, plastic or other rigid materials with a removable lid or a lid which rotates away from the container for exposing its contents. Large metal, wooden, stiff paper files or the like are well known for filing documents or the like. Some of these files are not considered to be portable. Soft files which are generally expandable and expand according to the volume of contents therein are constructed of heavy paper, leather or the like are well known and widely used. Hard files are generally cumbersome to transport and store as they generally take the size of the items which are intended to be filed therein while soft files are easily distorted or damaged which can cause damage to the contents stored therein.

Until the emergence of this invention, there has not been an entirely satisfactory small hard file which is size adjustable for ease of transport and storing, the contents are protected from damage and can be readily expandable for use.

SUMMARY OF THE INVENTION

The invention is directed to a portable hard file which when in use for removing from and filing items for storage therein has a height slightly less than the height of the largest item to be filed therein and can be selectively reduced in height for transporting or storing. The file comprises an outer housing with a translatable "roll top desk" type top and an inner file storage container. The file storage container has an open top and bottom, and an end wall adjacent the outer housing end wall and a carrying handle. The file storage container is translatable between file displayed and stored positions relative to the outer housing. A plurality of file divider walls are removably positionable at selected locations within the container. The sides of the file divider walls are pivotly connected through a fixed pivot which is translatable relative to the container side walls and on their bottom to a fixed in position housing bottom surface. These file divider wall connections allow the file divider walls to translate from a file use position generally perpendicular relative to the housing bottom to an acute angle position relative to the housing bottom when the container is in its transport or stowed position. In stowed file position the acute angles between the file divider walls and the housing bottom the pockets formed thereby maintain the filed material thence while the file is being transported. The file divider walls extend through the file housing upper opening when in a file use or deployed container position and are angled to extend below the upper surface of the housing in the file container stowed position. The lid is translatable over the upper surface opening when the container is in its stowed position. The container is automatically locked to the housing when in its stowed position to prevent undesired translation of the container within the housing. A handle is located on the external distal end of the container for transporting the file and for container translations relative to the housing. In one embodiment the handle conceals one or more punch and die sets for providing Rolodex ® type file card attachments slots in plain file card stock.

In one embodiment the file divider walls have a central opening and additional openings are provided along the bottom of the housing at selected locations to removably secure tabs and bars for slotted file cards such as Rolodex ® or similar types. The portable file of the invention can be used with only slotted file cards, nonslotted file cards or combinations of both.

The container handle end of the housing may include a dust cover.

An object of this invention is to provide a file container that can be reduced from its normal in use height to a smaller height for transport or storage without effecting the contents therein.

Another object of this invention is to provide a portable file which can be reduced in height to a smaller height for transport or storage which includes a lid which can be translated to the bottom of the file for storage when the file is in use and close the file access when the file is not in use.

Another object of the invention is to provide a means for locking the translatable file container to the outer housing for transport.

Still another object of the invention is to provide a file of the type described which is adaptable either entirely or partially to hold and secure therein slotted file cards of the Rolodex ® type.

Yet another object of the invention is to provide a file that fully protects the contents therein while being transported.

Still another object is to provide a file material pocket between the divider walls and housing bottom for ease of transport.

Still a further object is to provide a punch and die system concealed in the handle for forming Rolodex ® type attachment slots in file card stock.

Further objects and advantage will become apparent from the following description and claims and from the accompanying drawings.

DETAILED DESCRIPTION OF THE PREFERRED EMBODIMENTS

The invention is directed to a portable file 10 in which the file container can be translated within a housing from a file use configuration (deployed) to a file transport or storage configuration (stowed).

Referring now specifically to FIGS. 1–4, the figures show the portable file 10 of the invention in various operating configurations or modes.

Figure 1:
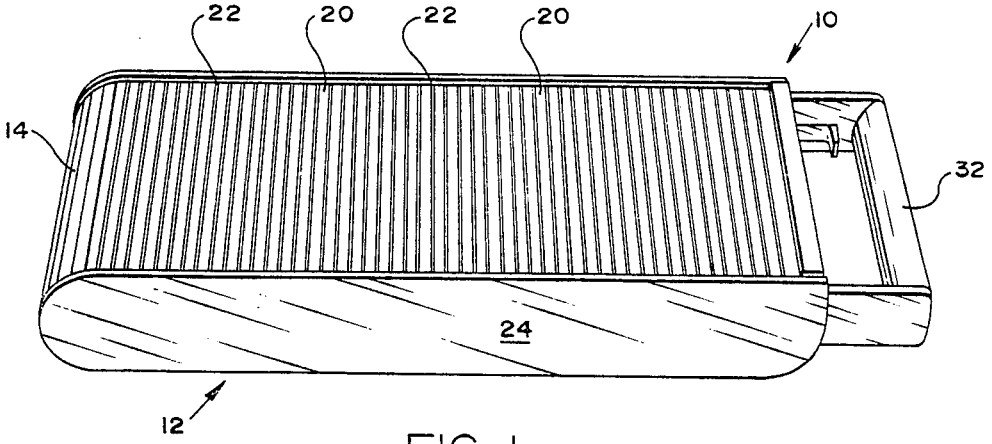
FIG. 1 is a perspective showing of the file of the invention in a stowed or transport mode.
Figure 2:
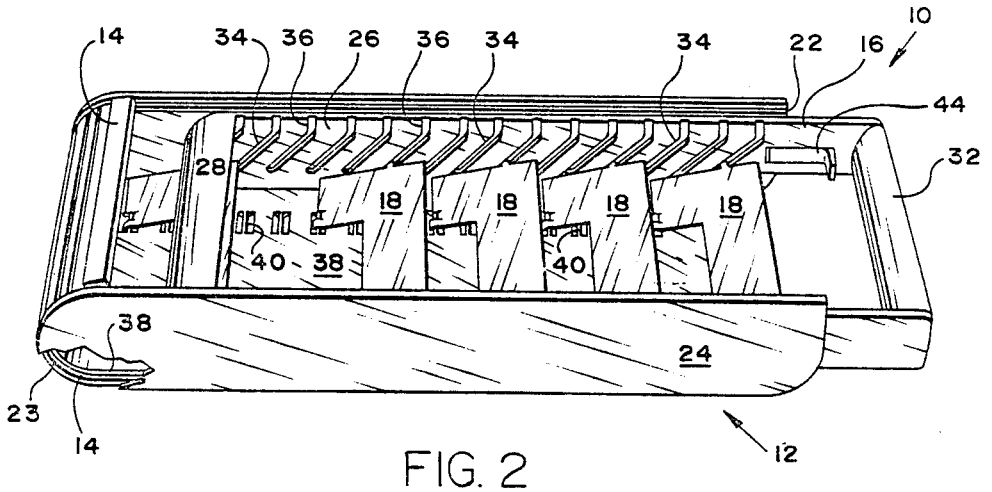
FIG. 2 is a perspective showing of the file if FIG. 1 in a lid and file stowed position.
Figure 3:
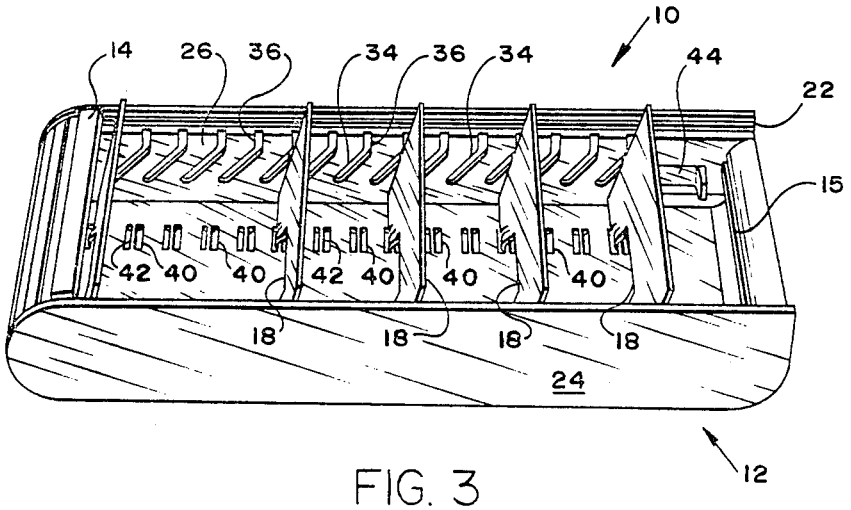
FIG. 3 is a showing of file of FIG. 2 with the file container translated to the file position and the inclusion of a punch and die set within the carrying handle.
Figure 4:
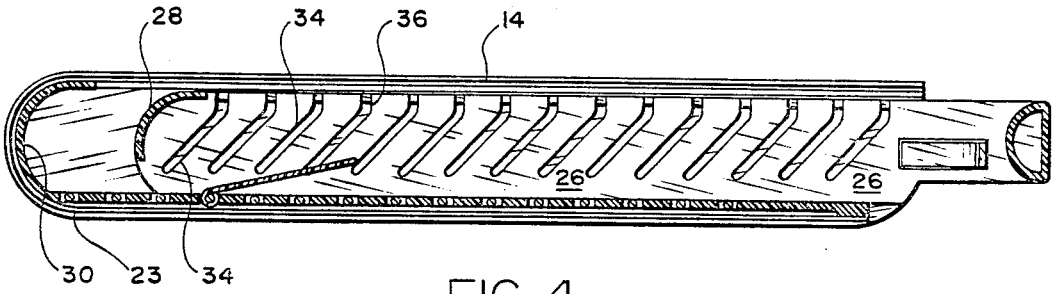
FIG. 4 is an inner side view showing of a typical file container side wall.

FIG. 1 shows the portable file 10 in a stowed mode for transport or storage, FIG. 2 shows the portable file of FIG. 1 with the lid 14 translated to a stowed position exposing the file compartment 16 and FIG. 3 shows the portable file in a use or file compartment displayed or use mode and further includes a two part handle member 15 which can be squeezed together for punching Rolodex® type file card attachment openings in conventional file cards inserted between the parts.

The portable file 10 comprises several principle elements, namely, an outer file housing 12 with a translatable "roll top" type cover or lid 14, a translatable file compartment 16 and file compartment divider walls 18.

The cover or lid 14 is of the same general type flexible cover well known for use on "roll top" type desks or the like. The lid may be constructed using a plurality of side-by-side narrow slats 20 adhered to a flexible backing material 22 such as, for example cloth, plastic, leather or like materials. It has been found that similar "roll type" covers can be constructed from a sheet of flexible material such as, for example, poly-propylene with its upper or cover outer surface grooved to provide spaced apart parallel indentations 22 along the material which provide the appearance of slats 20 with the indentations therealong providing the flexibility required to provide the bending of the cover when translated around the end surface.

The lid or cover 14 is captured within slotted tracks 23 along the outer edge of the inside surfaces of walls 24 of the outer file housing 12. The lid 14 is translatable along the slots between its FIG. 1 and 2 locations. When in the FIG. 2 position, the lid is translated around inside surface of the walls 24 to a position at the bottom of the portable file 10 below the housing bottom surface member 38.

The translatable file compartment 16 has a pair of longitudinal opposing side walls 26 closed at one end by a curvilinear end surface 28 designed to conform with the inner surface of the end wall 30 of the outer file housing 14. The other end of the compartment 16 forms a unitary handle member 32 or a two portion handle member 15. Handle embodiment 15, includes at least one punch and die set for file card punching (hereinafter explained in more detail).

The side walls 26 have elongated angled slots 34 on their opposing surfaces. These slots 34 can be angled at any convenient angle for the purpose for which they are intended. Typically the elongated slots 34 are angled in the range of from 30° to 65° from the horizontal edge of the side walls 26. An angle of about 45° is generally preferred. The slots 34 terminate intermediate the top and bottom edges of the side walls 26. Extending from the upper edge of each slot 34 to the upper edge of the side walls 26 is an extension slot 36 which is substantially perpendicular to the top and bottom edges of the side walls 26.

The file compartment 16 fits within the confines of the outer file housing 12 and is translatable relative therein to an extent hereinafter defined. The file compartment is either guided in its translation by the inner surface of the housing side walls 24 or by a guide means therebetween such as, for example, a tongue and groove engaging relationship (not shown).

Figure 6:
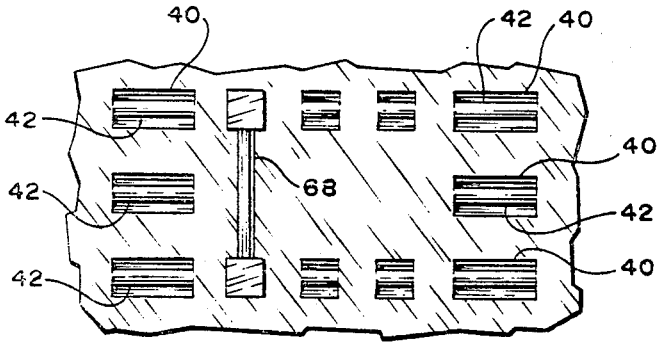
FIG. 6 is a partial plan view of a second embodiment of the file bottom surface.

The lower portion of the outer file housing 12 is enclosed by a bottom surface member 38. The bottom surface member is fixedly attached to the side walls 24 and is positioned above the guide tracks 23 of the outer housing lid or cover 12 so that when the cover is in the FIG. 2 and 4 positions it is physically positioned below the bottom surface member 38. The bottom surface member has a plurality of pairs of elongated apertures 40 therethrough. The apertures 40 are spacedly positioned along the bottom member near each outer edge thereof. Each aperture 40 includes a centrally positioned hinge bar 42. The hinge bar is generally circular in cross-section and acts as a hinge pin. Groups of similar pairs of aperture 40 with similar hinge bars 42 may be located in a single row along the longitudinal center line of the bottom member and/or in two rows adjacent each other on each side of the longitudinal center of the bottom member (see FIG. 6).

Figure 8:
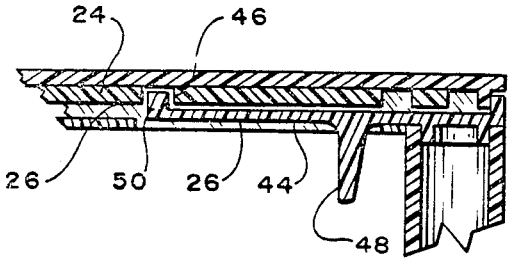
FIG. 8 is a cutaway showing of the locking mechanism for locking the housing and file container wall together.

The translatable file compartment 16, as discussed above, is positioned within the outer file housing 12 and is translatable relative thereto. Translation may be accomplished by grasping the outer housing 12 and handle member 15 or 32 and moving them away from or toward each other. In one of the walls 24, see FIG. 8, includes a file compartment to housing locking member 44. When engaged with a locking slot 46 on an adjacent wall 24 locking member 44 prevents relative translation between the outer file housing and the file compartment. The locking member comprises a portion of wall 26 cut away on three sides and with the fourth side integral with the wall. An actuating tab 48 is located on the inner side of the wall 26 and a locking tab 50, engagable with the locking slot 46, protrudes from the inner surface of wall 24 on the side opposite the actuating tab 48. Several spaced apart locking slots 46 may be positioned along wall 24 for locking the file compartment to the outer housing at various selected locations, typically at the maximum file compartment translation in either direction and in between. The fourth integral side of the locking member acts as a hinge for locking member movement. The locking member normally lies along the same plane as the wall 26 and is, therefore, designed to be in a locking position when at rest. The width of the locking member is considerably shorter then its length. This allows the locking member to be more easily flexed out of its locking position by movement of actuator 48 and also provides attachment strength at the hinge.

Figure 5:
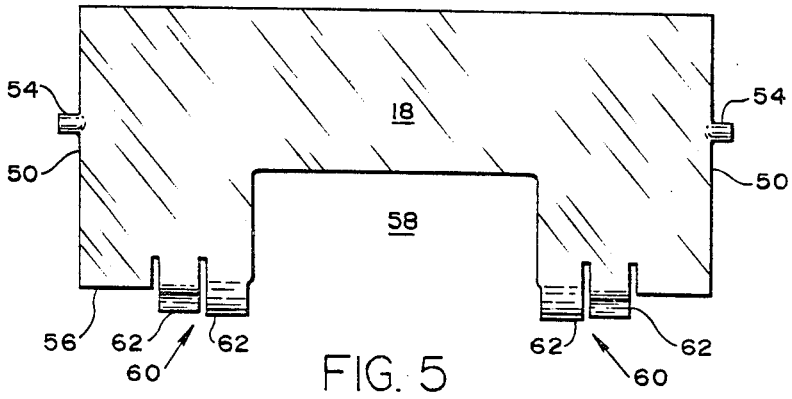
FIG. 5 is a front view of a removable file divider wall.

The file compartment divider walls 18, as shown in FIG. 5, are generally rectangular in plan. The vertical sides 50 each have a generally round protruding axle member 54 extending therefrom. The configuration of the axle members conform to the configuration of the bottom of angled slots 34. The central portion of the file compartment divider wall lower surface 56 may be cut away to form the opening 58 shown. Adjacent to the opening 58 on each side thereof is a hinge member 60. Each hinge member 60 comprises a pair of adjacent tabs 62. The interior surface of the pairs of adjacent tabs 62 form a bore which conforms to the circular hinge bar 42 within the apertures 40 which receive the tabs 62.

When the file compartment divider walls are installed into the file, the axle members 54 are inserted into the upper open surface of vertical extension slot 36 and then downward into the angled elongated slot 34, while maintaining the divider wall bottom edge 56 parallel to the outer housing bottom 38. When the adjacent tabs 62 of the hinge member 60 contact the outer housing bottom member they are forced downward until the axles 54 bottom out in the elongated slots 34. In this position of the file compartment divider wall tabs 62 have engaged and surrounded hinge bar 42. With the file compartment divider cards now in position they rotate about the hinge bar 42 and translate along elongated slot 34 when the file compartment 16 is caused to translate relative to the outer housing 12. The rotation and translation causes the file compartment divider walls to form the smallest angle with the bottom member when the file compartment is translated to a maximum outward position relative to the outer housing and to be angled substantially upright,away from the bottom when the file compartment is translated to a maximum inward position relative to the outer housing.

Figure 12:
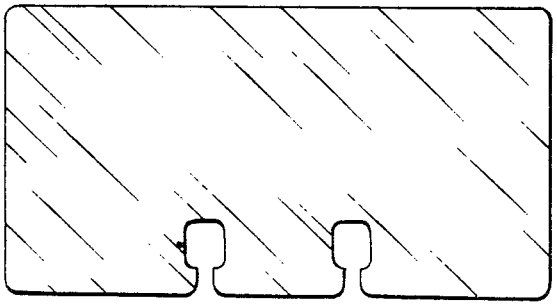
FIG. 12 depicts a typical slotted file card of the Rolodex® type.

Referring now to FIG. 12 conventional removable index cards of the type that have one or more open slots along their bottom surface for connecting to a bar or the like such as but not limited to those index cards generally referred to as Rolodex® cards may be used in the file of this invention.

Figure 7:
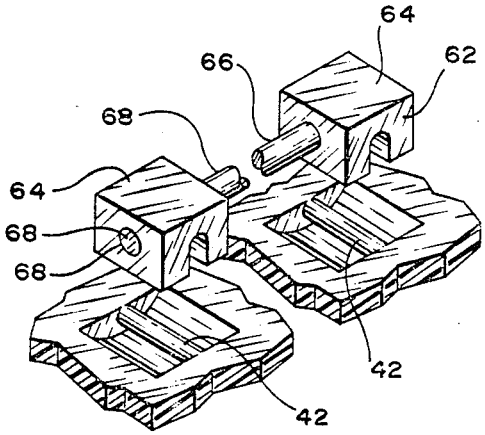
FIG. 7 is a perspective showing of a Rolodex ® type file card adapte for use with the second embodiment of the file bottom surface of FIG. 6.

Referring now to FIG. 7, when it is desirable to use the Rolodex® type of conventional index card in the file of this invention, pedestals 64 which, like hinge members 60, have extending tabs 62 to surround and engage a hinge bar 42. The pedestals have apertures 66 to engage and hold in place a central rod 68 which extends longitudinal along the bottom member to grasp and engage the slots of the Rolodex® index cards in a conventional known manner. The openings 58 allow the file compartment divider wall to pass freely over the pedestals and rod. A portion of the file compartment or all of the file compartment can be adapted to receive the Rolodex® type index cards.

In use, a desired number of file compartment divider walls are installed in selected locations as well as the required pedestals and bars in the file compartment. For use, the handle member 15 or 32 is pushed inward a maximum translation distance relative to the outer housing. In this position the file compartment divider walls have translated to the bottoms of the elongated slots 34 to a maximum position which is substantially perpendicular to the outer housing bottom member. Material is then filed into the file compartment between selected file compartment divider walls. When filing is complete, the filing compartment is then unlocked, if it is locked in the file use position, and the handle is then pulled outward relative to the outer housing to a maximum translated position whereby the file compartment divider wall axles members 54 translate to the top of the elongated slot 34 adjacent the bottom of slot 36 which causes rotation of the divider walls toward the bottom surface. In this file compartment translated position the lid can be slid along its guidance tracks 23 to cover the now open file. It should be noted that carrying the file by the handle member 15 or 32 maintains the file in the stowed mode.

Figure 9:
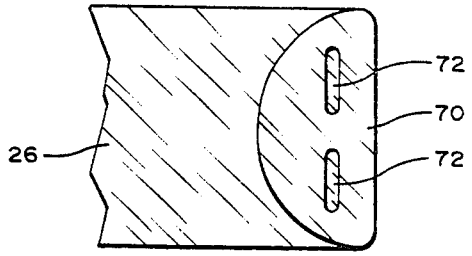
FIG. 9 is a side view of the handle end of the file container side wall showing the punch and die attachment slots.
Figure 10:
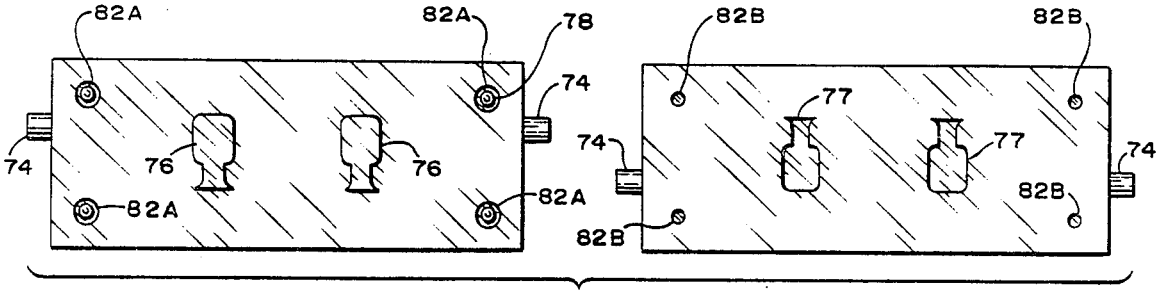
FIG. 10 is a plain view of the punch and die set of FIG. 3.
Figure 11:
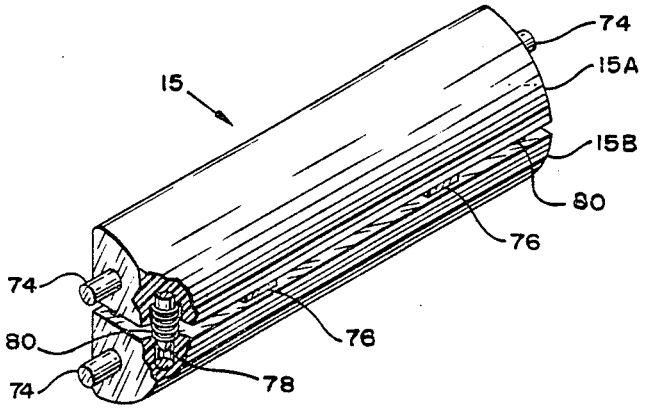
FIG. 11 is a rear perspective showing of the punch and die set.

Referring now specifically to FIGS. 9 - 11 which depicts the details of the punch and die set included in the handle 15 of FIG. 3.

FIG. 9 is a partial end view of the handle end of file container sides 26. The end 70 of both of the sides 26 include a pair of elongated spaced apart vertical slots 72. These slots receive the actuation guide pins 74 of handle portions 15A and 15B.

The upper handle portion 15A includes at least one male punch die 76 (two shown) and the lower handle portion 15B includes at least one mating female opening 77 to receive the male punch die or dies 76. When the handle portions of FIG. 11 have a file card positioned within slot 76 between the handle portions and the handle portions are brought together a punch or punches are made through the file card. Four alignment pins 78 with backing springs 80 are captured between apertures 82A and 82B maintain a normal separation between the handle portions providing the slot 76. As afore mentioned one or more aligned elements 76 and 77 may be employed. It is further contemplated that the elements 76 and 77 when used in pairs could be made moveable to provide different spacing between the holes to be punched in file cards.

FIG. 12 shows a typical slotted file card of the Rolodex® type for attachment to bars 68.

While a particular embodiment only of this invention has been illustrated and described it will, of course, be understood that this invention should not be limited thereto, since many modifications may be made and therefore, it is contemplated by the appended claims to cover all such modifications as fall within the true spirit and scope of this invention.

What is claimed is:

1. A portable file comprising:

an open container having longitudinal sides, open and closed end surfaces and a bottom member;

a translatable compartment having side walls translatable within said container relative thereto;

a plurality of divider walls having sides and upper and bottom surfaces attached to and carried by said side walls;

engagement means positioned between said side walls and each side of said plurality of divider walls, said engagement means allows a predetermined length and direction of movement of said divider walls relative to said side walls when said translatable member is translated; and hinge means interconnected between said divider walls and said base member;

when said translatable compartment is translated away from said closed end surface said engagement means causes said divider walls to rotate about said hinge means and translate relative to said side walls to a position wherein the upper surface thereof are within said container and when said translatable member is translated toward said closed end surface said engagement means causes said divider walls to rotate about said hinge means and translate relative to said sides to a position wherein the upper surface extend above said container.

2. The invention as defined in claim 1 wherein said plurality of divider walls are individually removable and re-attachable to said translatable compartment and bottom member at selected locations.

3. The invention as defined in claim 1 which further comprises a removable lid member which encloses said open container and prevents translation of said translatable member.

4. The invention as defined in claim 3 further comprising a lock means for selectively securing said lid to said translatable member together when said lid encloses said container opening and said translatable member is translated away from said closed end surface and the upper surfaces of said divider walls are within said container.

5. The invention as defined in claim 3 wherein said lid member is translatable from the opening of said container by the sliding of said lid member from over the opening of said container to a location adjacent to said base member.

6. The invention as defined in claim 5 wherein said lid comprises a plurality of parallel slots interconnected by flexible material.

7. The invention as defined in claim 5 wherein said lid comprises an integral sheet of material having areas of reduced thickness along its length, said areas of reduced thickness provide a hinge between adjacent portions of said sheet of material for relative rotation therebetween.

8. The invention as defined in claim 1 wherein said translatable compartment has a plurality of slots and said divider wall sides have slot engaging tabs for removable attachment to the slots of said translatable compartment.

9. The invention as defined in claim 1 wherein said engagement means comprises elongated slots in said side walls and protrusions on each side of each of said divider walls for engagement therewith.

10. The invention as defined in claim 9 wherein said slots are angled relative to the bottom member.

11. The invention as defined in claim 10 wherein the angle of said slots is from 30° to 65°.

12. The invention as defined in claim 10 wherein the angle of said slots is substantially 45°.

13. The invention as defined in claim 1 wherein said translatable compartment extends from the open end surface of said container and further comprises a carrying handle on the extended portion of said compartment.

14. The invention as defined in claim 13 additionally comprising a lock means for selectively engaging said translatable member to said container.

15. The invention as defined in claim 13 further comprising means removably attachable to the bottom surface of said container for the removable attachment of slotted file material thereto and a punch means contained in said carrying handle for forming the slots in said slotted material.

16. The invention as defined in claim 1 wherein said plurality of divider walls have the central portion of their bottom surfaces removed forming an opening there through.

17. The invention as defined in claim 16 wherein at least one file card receiving bar extends through said opening of at least one divider wall.

* * * * *